US008250669B2

(12) United States Patent
Gafforio et al.

(10) Patent No.: US 8,250,669 B2
(45) Date of Patent: Aug. 28, 2012

(54) SAFETY HELMET WITH SUPPLEMENTAL INNER VISOR

(75) Inventors: Luca Gafforio, Comun Nuovo (IT); Gabriele Tomasoni, Bariano (IT); Alberto Salvetti, Bergamo (IT)

(73) Assignee: Opticos, S.r.l., Brembate di Sopra (IT)

( * ) Notice: Subject to any disclaimer, the term of this patent is extended or adjusted under 35 U.S.C. 154(b) by 913 days.

(21) Appl. No.: 12/210,740

(22) Filed: Sep. 15, 2008

(65) Prior Publication Data

US 2009/0070908 A1 Mar. 19, 2009

(30) Foreign Application Priority Data

Sep. 18, 2007 (EP) ..... 07425573

(51) Int. Cl.
*A41D 13/08* (2006.01)

(52) U.S. Cl. ..... 2/15; 2/410; 2/6.3; 2/6.4; 2/6.5; 2/6.7; 2/12

(58) Field of Classification Search ..... 2/10, 12, 2/15, 410, 6.3, 6.5, 6.7, 171.4, 173, 424, 2/431, 432, 438, 451, 453, 454; D29/110, D29/122

See application file for complete search history.

(56) References Cited

U.S. PATENT DOCUMENTS

| | | | | | |
|---|---|---|---|---|---|
| 3,310,811 | A * | 3/1967 | Iacono, Jr. | ..... | 2/6.5 |
| 4,507,809 | A * | 4/1985 | Stepan | ..... | 2/424 |
| 5,177,817 | A * | 1/1993 | Kamata | ..... | 2/424 |
| 5,182,816 | A * | 2/1993 | Arai | ..... | 2/424 |
| 5,475,878 | A * | 12/1995 | Dawn et al. | ..... | 2/411 |
| 5,890,233 | A * | 4/1999 | Kaffka | ..... | 2/424 |
| 5,987,651 | A * | 11/1999 | Tanaka | ..... | 2/424 |
| 6,125,477 | A * | 10/2000 | Crippa et al. | ..... | 2/422 |
| 6,134,719 | A | 10/2000 | Kuo | | |
| 6,301,721 | B1 * | 10/2001 | Arai | ..... | 2/424 |
| 6,405,373 | B1 * | 6/2002 | Grau | ..... | 2/15 |
| 6,557,185 | B1 * | 5/2003 | Lee | ..... | 2/424 |
| 6,732,380 | B1 * | 5/2004 | Lee | ..... | 2/424 |
| 7,757,309 | B2 * | 7/2010 | Schimpf | ..... | 2/424 |
| 2001/0054188 | A1 * | 12/2001 | Guay et al. | ..... | 2/6.4 |
| 2002/0178488 | A1 * | 12/2002 | Harris | ..... | 2/424 |
| 2003/0217408 | A1 * | 11/2003 | Fournier | ..... | 2/424 |

(Continued)

FOREIGN PATENT DOCUMENTS

DE 44 16 921 11/1995

(Continued)

*Primary Examiner* — Khoa Huynh
*Assistant Examiner* — Andrew W Collins
(74) *Attorney, Agent, or Firm* — Lucas & Mercanti, LLP

(57) ABSTRACT

Protective helmet of the type comprising a first outer visor to intercept the viewing aperture of the helmet mounted rotatably on said helmet, a second visor mounted, inside said first outer visor, rotatably on the cap of the helmet, and a device for actuation and mounting of said second visor on said cap, said second visor including a shielding portion and two ends at the sides of said shielding portion and being at least partly elastically deformable. The inner visor comprises, at least at one side end thereof, a fork and, at or in proximity of one or other of the side ends thereof, at least one externally projecting tooth. Correspondingly, said device for actuation and mounting comprises at least one pin for engaging, directly or indirectly, with said fork and at least one circular guide inside which said projecting tooth of said second visor is removably coupled in a sliding manner, said at least one pin and said at least one circular guide being integral and/or integrated with said cap.

16 Claims, 7 Drawing Sheets

U.S. PATENT DOCUMENTS

| | | | | |
|---|---|---|---|---|
| 2004/0010833 | A1* | 1/2004 | Heine et al. | 2/12 |
| 2004/0187195 | A1* | 9/2004 | Wang Lee | 2/410 |
| 2005/0273912 | A1* | 12/2005 | Gafforio et al. | 2/424 |
| 2006/0000010 | A1* | 1/2006 | Halsnes et al. | 2/424 |
| 2007/0056071 | A1* | 3/2007 | Smith | 2/5 |
| 2007/0067887 | A1* | 3/2007 | Lee | 2/12 |
| 2007/0124851 | A1* | 6/2007 | Pyo | 2/424 |
| 2007/0124852 | A1* | 6/2007 | Pyo | 2/424 |
| 2007/0136933 | A1 | 6/2007 | Kim et al. | |
| 2008/0028501 | A1* | 2/2008 | Schimpf | 2/424 |

FOREIGN PATENT DOCUMENTS

| | | |
|---|---|---|
| DE | 203 11 159 | 9/2003 |
| EP | 2039260 | 3/2009 |

* cited by examiner

SAFETY HELMET WITH SUPPLEMENTAL INNER VISOR

CROSS-REFERENCE TO RELATED APPLICATIONS

This application claims the benefit of priority from European Patent Application Serial Number 07425573.8 filed Sep. 18, 2007, the contents of which are incorporated herein by reference.

BACKGROUND OF THE INVENTION

The present invention relates to a protective helmet, in particular for motorcyclists, of the type comprising a first outer visor to intercept the viewing aperture of the helmet, mounted rotatably on said helmet, and a second visor, preferably for partly shielding the sun's rays, mounted rotatably on the cap of the helmet, in an internal position with respect to the outer visor.

It is known in the art to provide protective helmets for motorcyclists with an additional visor for partly shielding the sun's rays which overlaps in part the visor, usually transparent, intercepting the viewing aperture of the helmet. Actuation of said additional visor is mechanically separate from actuation of the interception visor and must allow the user to engage or disengage said additional visor with or from the field of vision of said user, separately from the position taken by the transparent visor.

The Italian patent IT 1.177.250 by the applicant Bayerische Motoren Werke Aktiengesellschaft (BMW) describes a similar protective helmet for motorcyclists, in which the additional visor for partly shielding the sun's rays is mounted, with at least a degree of freedom, on the cap of the helmet so that it is in an internal position with respect to the transparent visor. The particular constraint of said additional visor inside the cap allows said additional visor to move between a position partly intercepting the viewing aperture of the helmet and a position disengaged therefrom, wherein said additional visor is housed inside a seat specifically provided in said cap.

The internal configuration of the addition visor with respect to the transparent visor allows greater protection thereof against external agents and also prevents the additional visor from being accidentally actuated by the user. In this way, the additional inner visor does not obstruct the aerodynamic function of the outer visor and, if said inner visor is of the type for partly shielding the sun's rays, it acts only as an anti-dazzle visor, without necessarily having to protect the user from other external agents.

The European patent application EP-A-1 393 642 by the applicant Osbe Srl relates to a protective helmet comprising an addition visor for partly shielding the sun's rays, positioned internally with respect to the transparent visor. This additional visor described in the Osbe application is hinged at the side to the cap and is provided with a kinematic actuation mechanism comprising a tie constrained in rotation to one end of the inner visor and constrained, at the other end thereof, to a manual control, positioned on the outside of the cap of the helmet.

The Osbe application does not provide for removable coupling of the additional inner visor with the cap, but rather the side ends of the inner visor are constrained to two coaxial pins, positioned on the inner walls of the side portions of the viewing aperture of the cap of the helmet.

This means that any operations to remove and mount the inner visor, necessary for cleaning, maintenance or replacement thereof, are particularly complicated, requiring specific tools and the removal of several portions of the helmet.

The international patent application WO 2006/037295 by the applicant Schuberth Engineering AG describes a protective helmet for motorcyclists wherein a sun visor is constrained, internally with respect to the transparent visor intercepting the viewing aperture of the helmet, using projections, or followers, integral with the side ends of said sun visor, with relative circular guides integral with the cap of the helmet. The sun visor of this Schuberth application is therefore not constrained to any pin inside the cap and rotation thereof is permitted, and limited, by said circular guides. Rotation of the sun visor described in WO 2006/037295 is controlled by a manually actuated slider, constrained in translation to the cap, through some ties that connect the slider to one end of said sun visor.

Although allowing a reduction of the overall dimensions of the sun visor in the cap and allowing, with modification of the curvature radius of the circular guides, the centre of instantaneous rotation of the sun visor to be positioned as desired, in the Schuberth solution the projections of the sun visor inserted in the circular guides must support all the loads to which the sun visor is subjected, above all during actuation thereof, resulting in possible problems of wear and premature deterioration.

Moreover, as the assembly of the sun visor inside the Schuberth helmet does not provide for any type of centering, it is made difficult by misalignment, which in fact can take place during operations to mount one or other end of this inner visor, of the projections of the sun visor with respect to the two circular guides.

Finally, the practical embodiment of the Schuberth solution proves to be complex and therefore with possible drawbacks linked to the reliability and functionality of the relative helmet.

SUMMARY OF THE INVENTION

An object of the present invention is to provide a protective helmet of the aforesaid type, that is, provided with a first outer visor and a second inner visor, preferably for partly shielding the light, which does not have the drawbacks of prior art.

It is therefore the object of the present invention to provide a helmet that prevents premature deterioration of the inner visor and is also simple to assemble.

Another object of the present invention is to provide a protective helmet, of the type comprising two overlapping visors, that allows easy replacement of the aforesaid inner visor, while preventing the accidental removal thereof.

A further object of the present invention is to provide a protective helmet of the type indicated above, the inner visor of which is easy for the user to actuate.

These and other objects are achieved by the protective helmet in accordance with the first independent claim and the subsequent dependent claims.

The protective helmet according to the invention comprises a first outer visor to intercept the viewing aperture of the helmet, mounted rotatably on part of said helmet, a second visor mounted internally to said first outer visor, in a rotating manner on the cap of the helmet, and a device for actuation and mounting of the second visor. The second visor, which comprises a shielding portion and two ends at the sides of said shielding portion, is at least partly elastically deformable.

Advantageously, said inner visor also comprises, at least on one side end thereof, a fork and, at or in proximity of one or other of the side ends thereof, at least one externally projecting tooth. Correspondingly, the device for actuation and mounting of the protective helmet according to the present invention comprises at least one pin for engaging, either directly or indirectly, with said fork and at least one circular guide inside which said projecting tooth of the second visor is removably coupled in a sliding manner, said pin and said circular guide being integral and/or integrated with the cap of the helmet.

Preferably, both ends of the inner visor comprise both a fork and an externally projecting tooth and, consequently, the aforesaid device for actuation and mounting of the inner visor has two corresponding pins and two corresponding circular guides, disposed in an integral or integrated manner, on the inner side walls of the cap.

The solution of the present invention, as will be easily understood by those skilled in the art, not only allows precise separate actuation of the outer visor and the inner visor, but also advantageously allows the additional inner visor to be constrained to the cap of the helmet in a simple and precise manner. In fact, during assembly, engagement of the pin, or pins, of the aforesaid device for actuation and mounting with the relative fork, or forks, of the inner visor acts as centering element to facilitate correct insertion, after elastic deformation of at least part of the inner visor, of the tooth, or teeth, of this inner visor inside the corresponding circular guide, or corresponding circular guides, of this device.

Moreover, resting the fork against the pin prevents all the loads that develop during actuation of the inner visor from being concentrated on the tooth of the visor engaged in the circular guide thereof, thereby decreasing the risk of damaging said tooth of the inner visor.

To sum up, due to engagement with the relative fork of the inner visor, the aforesaid pin defines the centre of instantaneous rotation of said inner visor and the tooth thereof, engaged in the corresponding circular guide, prevents accidental disengaging of said second visor from the cap of the helmet, maintaining the fork in contact with the pin thereof at all times.

According to another aspect of the present invention, the device for actuation and mounting of the additional inner visor, preferably of the type for partly shielding the light, comprises a manual control, such as a slider, constrained movably to the cap of the helmet, and at least one kinematic mechanism to transmit motion from the manual control to the inner visor, and vice versa.

According to another preferred aspect of the present invention, the device for actuation and mounting of the additional visor comprises means to limit rotation thereof between a top end of travel position, wherein the additional visor is disengaged from the viewing aperture of the helmet, and a bottom operational end of travel position, intercepting the viewing aperture of the helmet. These means to limit rotation of the additional visor can advantageously comprise at least one hook projecting from the top of the shielding portion of the additional inner visor and at least one stop for this hook, wherein the aforesaid stop is integral with the cap of the helmet.

By providing means to limit rotation of the inner visor at least partly separate from the circular guides of the device for actuation and mounting of said inner visor, the helmet of the present invention allows an increase in safety to be obtained during removal of the inner visor, without however reducing the simplicity of mounting thereof.

In fact, removal of the additional inner visor is dependent both on disengagement of this visor from the aforesaid means to limit rotation and on release of the projecting teeth of the visor from the relative circular guides of the device for actuation and mounting.

Moreover, in the case in which the aforesaid means to limit rotation of the inner visor comprise a top hook suitable to engage with a stop integral with the inside of the cap, removal of the visor, as will be apparent in the description below, implies the necessary elastic deformation of the inner visor in the region in which the aforesaid hook is present, in order to disengage the hook from the relative stop, and consequently a subsequent elastic deformation, in a different direction and manner from the former, to release the side teeth from the relative circular guides of the device for actuation and mounting.

Moreover, according to a further aspect of the present invention, to facilitate the removal operations indicated above, the circular guides have at least one extension that extends beyond the position reached by the relative projecting teeth of the inner visor, when this is positioned at the bottom operational end of travel position thereof.

Described hereunder, purely by way of a non-limiting example, are some preferred embodiments of the present invention, with reference to the attached figures.

DETAILED DESCRIPTION OF THE INVENTION

Figure 1:
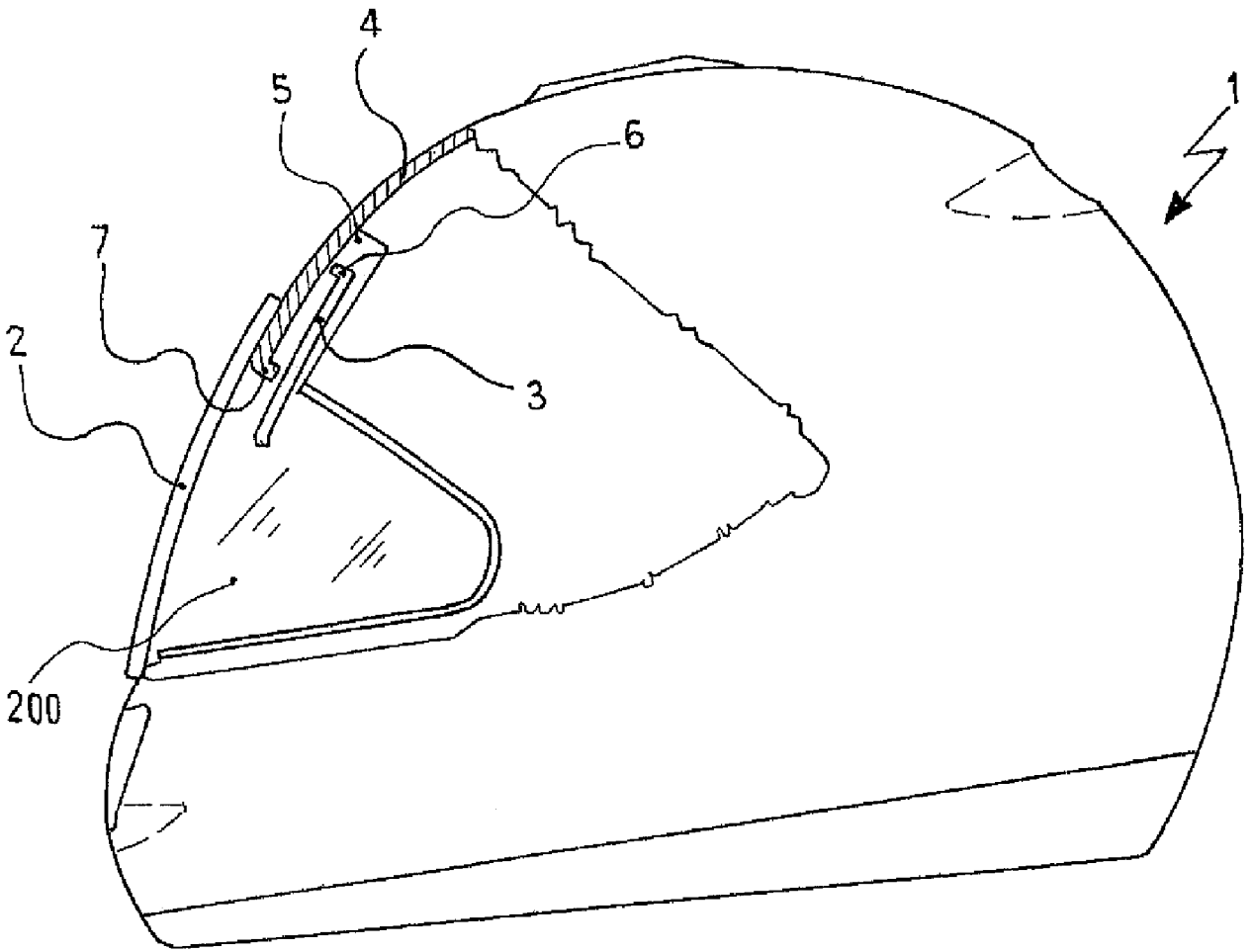
FIG. 1 is partially cross-sectional side view of a helmet according to a particular aspect of the present invention.

Firstly considering FIG. 1, the helmet 1, in the particular embodiment of the present invention illustrated herein, comprises a first visor 2, preferably transparent, mounted, according to prior art, rotatably on the cap 4 of said helmet 1, and a second visor 3, preferably of the type for partly shielding the sun's rays, also mounted rotatably on the cap 4, in an internal position with respect to the first visor 2, that is, closer to the eyes of the user when the helmet 1 is worn.

Both the outer visor 2 and the inner visor 3 are rotatable with respect to the cap 4, separately from each other, at least between a position completely disengaged from the viewing aperture 200 of the helmet 1 and a position intercepting, totally or partially, said viewing aperture 200.

With regard to the outer visor 2, although in the embodiment in FIG. 1 this is constrained in rotation to the cap 4 of the helmet 1, without departing from the scope of protection requested by the present patent, this outer visor 2 could alternatively be constrained in rotation to other parts of the helmet 1, such as a chin guard (not shown) that can be flipped up with respect to the cap 4. Therefore, the outer visor 2, just as the inner visor 3, of the present invention can be applied without distinction to full facial helmets, that is, with chin guard integral with the helmet 4, to jet helmets, that is, with no chin guard, and to helmets provided with flip-up chin guard.

The second inner visor 3, in the embodiment in FIG. 1, and the cap 4 are structured so that the inner visor 3 is housed in a suitable seat 5, produced under said cap 4, when said second visor 3 is not in the position of maximum interception of the aperture 200, corresponding to interception, by said visor 3, of the field of vision of the user.

Figure 2:
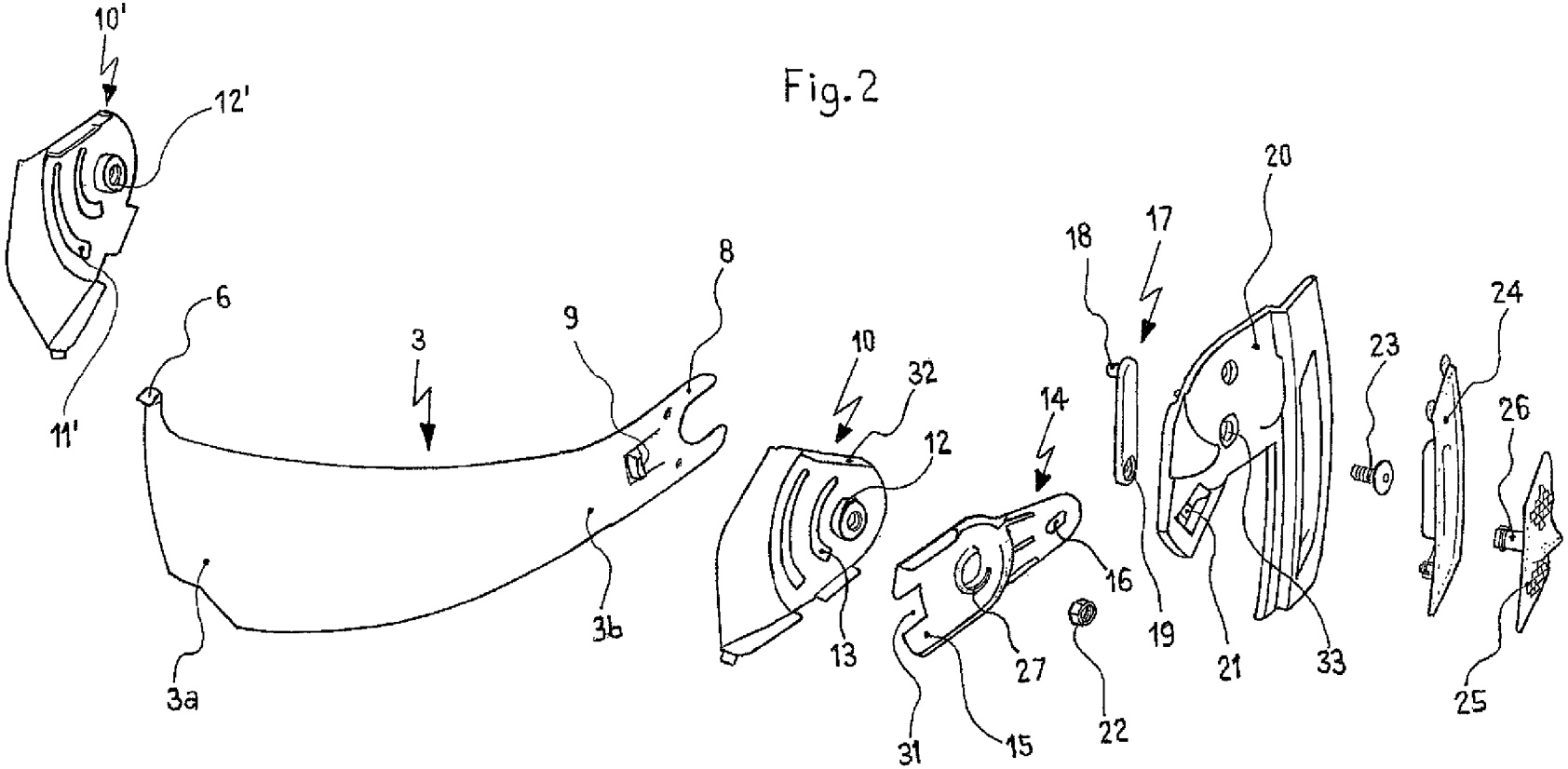
FIG. 2 is a partially exploded view of an additional inner visor and of the relative device for actuation and mounting of a helmet in an embodiment of the present invention.
Figure 3:
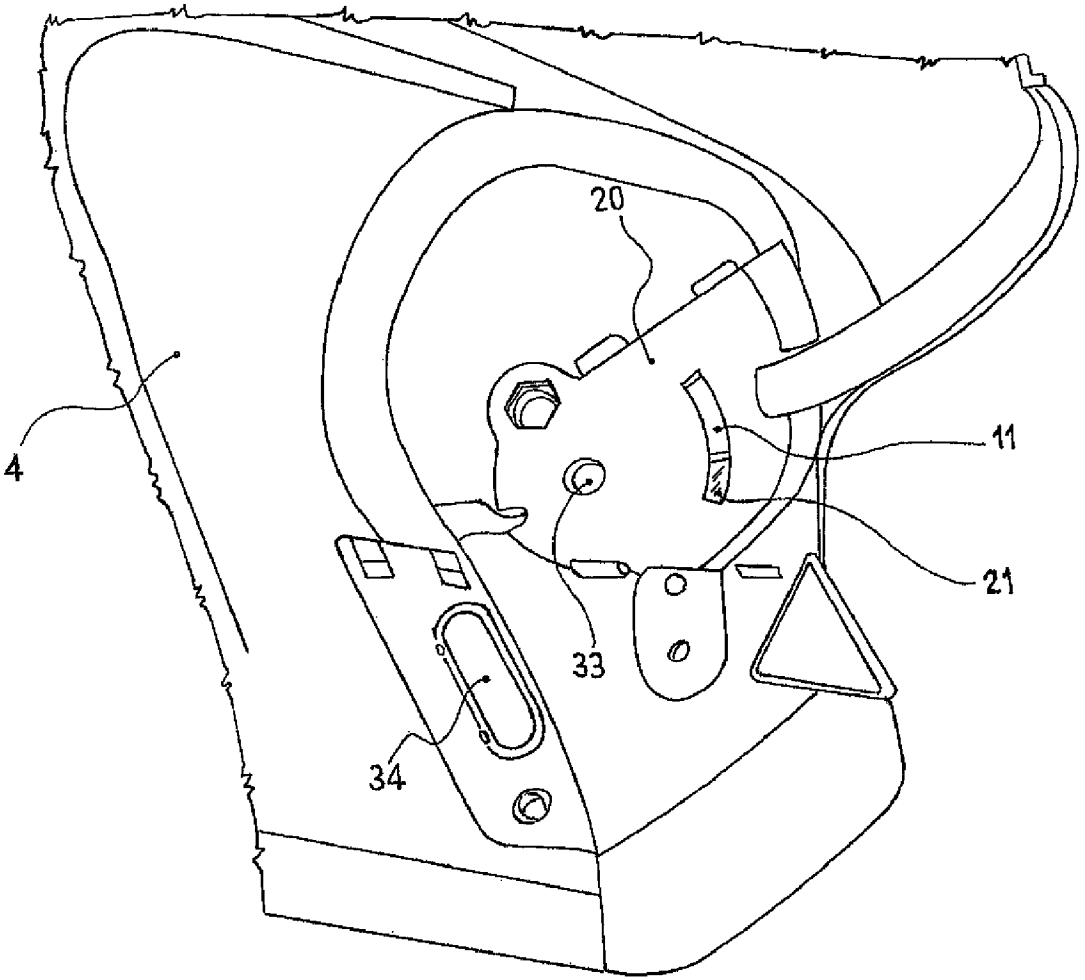
FIG. 3 is a partial front view of a portion of the inner surface of the cap of the helmet in FIG. 2 positioned at one end of said additional inner visor.
Figure 4:
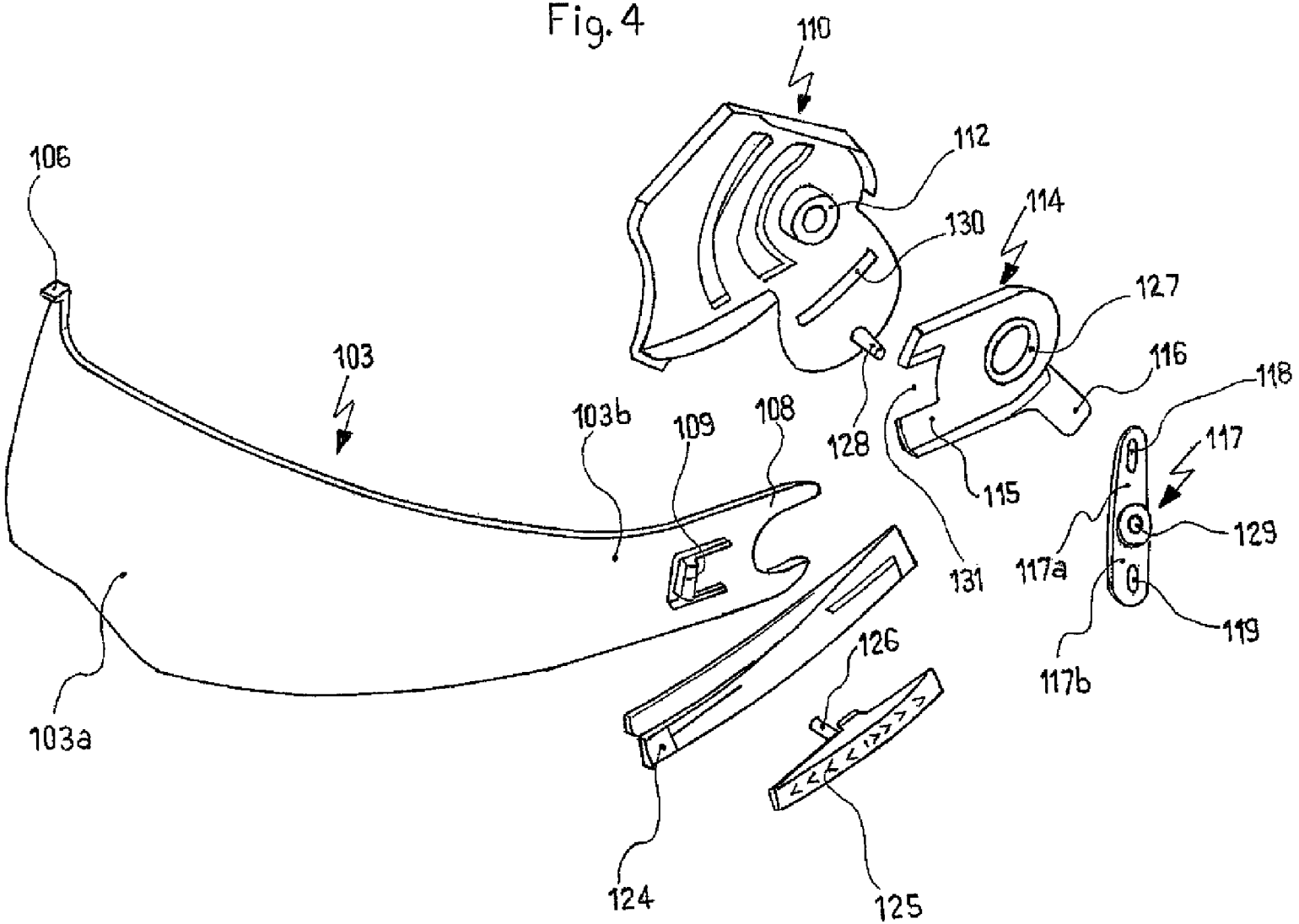
FIG. 4 is a partially exploded view of an additional inner visor and of the relative device for actuation and mounting of a helmet in a further embodiment of the present invention.
Figure 5:
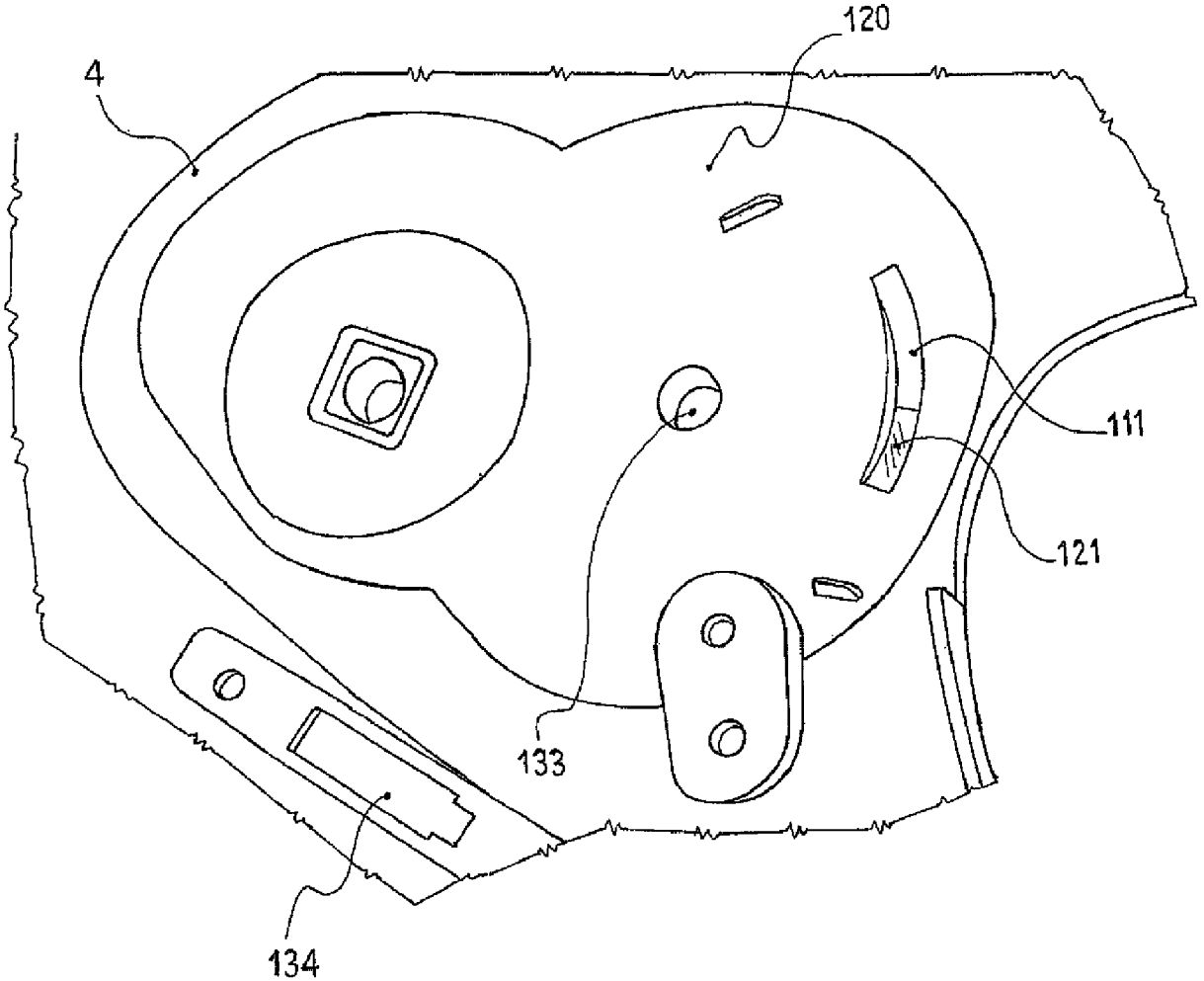
FIG. 5 is a partial front view of a portion of the inner surface of the cap of the helmet in FIG. 4.

It must be noted that any other solution that allows rotation of the visor 3 between the aforesaid disengaged position and the position intercepting the aperture 200 under the outer visor 2, over or under the cap 4 (and therefore with or without the seat 5), can alternatively be implemented. FIGS. 2 and 3 show in detail both the second inner visor 3 and the device for actuation and mounting of said second visor 3 on the cap 4.

As is well known in the art, the second inner visor 3, of which only the left half is visible in FIG. 2, comprises a central shielding portion 3*a*, intended to protect the eyes and/or the field of vision of the user from light and/or from any external agents, and two ends 3*b*, positioned at the sides of said portion 3*a*, for the purpose of allowing the visor 3 to be constrained to the cap 4. Said inner visor 3 also comprises at least one elastically deformable part thereof and, in a preferred embodiment, said visor 3 is in general made of an elastically deformable material, such as polycarbonate. The visor 3, according to the present invention, also comprises at least one fork 8, positioned at one side end 3*b* thereof, and at least one tooth 9, projecting outward (i.e. toward the cap 4), positioned at one or other of the side ends 3*b* of said visor 3. In the preferred embodiment of the present invention described herein, the visor 3 comprises, symmetrically on each side end 3*b*, both a fork 8 and a projecting tooth 9.

Each projecting tooth 9 of the embodiment described herein, positioned in proximity of the relative fork 8, is integral with the side end 3*b* by means of a flexible laminar portion, which makes this tooth 9 elastically deformable with respect to said side end 3*b*, in a direction incident to the surface along which said side end 3*b* extends.

Finally, the central shielding portion 3*a* of the visor 3 also comprises a hook 6, positioned at the top, the function of which will be explained below. The device for actuation and mounting of this inner visor 3 on the cap 4 of the helmet 1, in the particular embodiment in FIG. 2, comprises two side plates 10, 10', intended to be constrained to relative portions 20 of the cap 4 and provided with pins 12, 12' positioned substantially at the sides of the viewing aperture 200 of the helmet 1, a control lever 14, a tie 17, and a manual control 25, in the form of a slider translatable along a vertical direction, to actuate said visor 3, and side guides 11 with a substantially circular extension (see FIG. 3), produced inside the cap 4, on the aforesaid portions 20, at the sides of the aperture 200.

In more detail, each side plate 10, 10' comprises a pin 12, 12' intended to engage, directly or indirectly as will be explained below, with the relative fork 8 of the inner visor 3, and each portion 20 of the cap 4 has, on the inner wall thereof (that is, closer to the inner visor 3) a circular guide 11, constituted, in the particular embodiment of the present invention, by a partially blind groove, in the shape of an arc of circumference.

Following coupling of the relative fork 8 with the pin 12, 12' thereof of the plate 10 and insertion thereof inside the guide 11, each tooth 9 engages in a freely rotating manner in the circular guide 11 thereof inside the cap 4. It must be noted that progressive engagement of the fork 8 with the relative pin 12, during mounting of the visor 3 on the cap 4, facilitates centering of said visor 3 and therefore facilitates the subsequent step, following elastic deformation, to insert each projecting tooth 9 of the visor 3 inside the relative circular guide 11.

It must also be noted that although a particular circular guide 11, produced directly and integrally in the inner wall of the cap 4, as a cutout thereof, has been described, in alternative it would be possible to use circular guides produced separately from the cap 4, for example constituted by a profile made of plastic material, fastened integrally to said side walls of the cap 4.

Moreover, in an embodiment of the present invention, not shown here, the forks 8 can be structured so as to couple with the relative pin 12, 12' only after elastic deformation (and subsequent return) of at least one portion thereof. For example, the forks 8 can have a deformation, or inner protrusion, which must become slightly deformed to allow each fork to engage with and disengage from the pin 12, 12' thereof. This structure can further prevent, in the case of knocks, accidental release of the inner visor 3 from the aforesaid actuation and control device.

The control lever 14 of the actuation and control device of the helmet 1, shown here, comprises a bushing, or a hole, 27, intended to engage with the pin 12 of one of said plates 10, a region 15 provided with guides to house and retain the fork 8 of the visor 3 and a slot 16 suitable to engage with a pin 18 provided on one end of said tie 17. The region 15, in particular, is shaped in a manner to prevent relative movements between lever 14 and fork 8 of the visor 3 in directions transverse to the direction along which said fork 8 extends (and therefore the relative side end 3*b* of the inner visor 3) and has a cutout 31 inside which the relative tooth 9 of the end 3*b* of the inner visor 4 is inserted. This cutout 31 thus allows the tooth 9 to reach the circular guide 11 thereof, positioned inside the portion 20 of the cap 4.

It must be noted that, while one side end 3*b* of the inner visor 3 is constrained indirectly to the pin 12 through the control lever 14—that is, the relative fork 8 engages in rotation with the bushing 27, in turn constrained to the pin 12—as the other side end of the inner visor 3 is not normally connected to any manual control member, it is preferably constrained directly to the pin 12' thereof. As it is preferable for the inner visor 4 to be symmetrical, i.e. with two forks 8 of the same dimension, the solution described above implies that the pins 12 and 12' of the plates 10, 10' will preferably differ in diameter to each other.

Rotation of the control lever 14 about the pin 12 of the plate 10, given the constraint thereof (in the region 15) with the relative fork 8 of the inner visor 3, determines corresponding rotation of the inner visor 3 about the pins 12, 12' and therefore sliding of the projecting teeth 9 inside the relative circular guides 11 of the portions 20 of the cap 4.

The tie 17 also has, at the opposite end thereof to that of the pin 18, a hole 19 for the purpose of housing a further pin 26, with elastic head for snap engagement thereof with said hole 19, integral with the slider 25. In this manner, translation of the slider 25 determines corresponding translation of the tie 17 and rotation of the lever 14 about the pin 12 of the plate 10.

This slider 25 is also constrained to slide in a linear guide (not necessarily rectilinear) 24, fastened to the outside of the cap 4, at a through aperture 34 of the region 20 of said cap 4. The pin 26 passes through a specific hole produced on the linear guide 24 and through the through hole 34 of the region 20 in order to engage, as said, with the hole 19 of the tie 17.

The region 20 of the cap 4 also comprises a window 21, constituted by a through slot, which, as will be explained in greater detail below, is positioned in a bottom region of the circular guide 11, and some centering through holes and/or grooves to allow the plate 10 and the lever 14 to be constrained to this region 20. Symmetrically, a similar through slot (window) is provided in the cap 4 in a bottom region of the circular guide produced inside said cap 4, on the opposite side with respect to the viewing aperture 200 of the helmet 1.

As mentioned above, also with reference to FIG. 1, the inner visor 3 comprises a top hook 6 intended to engage with a stop 7 projecting inside the cap 4, at the top edge of the viewing aperture 200 of the helmet 1, and integral with said cap 4. The hook 6 projecting from the top of the shielding portion 3*a* of the inner visor 3, the stop 7 of the cap 4 and the top end wall of the housing 5 for said inner visor 3 (or alternatively the top end of the circular guides 11, or even possible engagement of the lever 14 against the top side 32 of the plate 10), constitute means for limiting rotation of the inner visor 3 with respect to the cap 4 between a top end of travel position, given by the top end wall of the housing 5 (or alternatively by the top end of the circular guides or by the top side 32 of the plate 10) and wherein the inner visor 3 is not engaged with the viewing aperture 200 of the helmet 1, and a bottom operational end of travel position, wherein the hook 6 is engaged with the stop 7, with said visor 3 intercepting said viewing aperture 200 of the helmet.

It must be noted that, in order to maintain the inner visor 3 at least in a raised position, the linear guide 24, or alternatively the plate 10, has elastically deformable protrusions that couple with opposed projections produced on the inner wall (that is, facing the linear guide 24) of the slider 25, or on the inner wall of the lever 14, and which can be elastically deformed, so that they can be released from the corresponding projections, only as a result of the action of the user. These protrusions, and corresponding projections, which form a temporary elastic locking, or "snap fastening" system, of the position of the inner visor 3, are structured and disposed so as to define and elastically lock at least those angular positions of the control lever 14 corresponding to total opening of the visor 3 and to operational closing thereof (i.e. when the visor 3 is lowered but is not at the end of travel) wherein coupling of the hook 6 with the stop 7 is also implemented.

It must also be noted that, in the particular embodiment shown in FIG. 2, limitation of the rotation of the inner visor 3 is given, at least for downward rotation thereof, only by said means 6, 7 to limit rotation and is not entrusted to the extension of the circular guides 11, and therefore engagement thereof with the relative teeth 9 of said visor 3. In fact, these circular guides 11 are dimensioned so that at least one portion thereof extends downward beyond the position reached by the projecting teeth 9 when the visor 3 is in the aforesaid bottom operational end of travel position thereof, given by engagement of the hook 6 with the stop 7. Once the hook 6 has been released from the stop 7, this downward extension of the circular guides 11 allows overtravel of the inner visor 3 with respect to the cap 4.

In the particular embodiment described herein, said window 21 of the region 20 of the cap 4 is disposed at said downward extension of at least one of the circular guides 11, so that the user can reach said extension of the guide 11 from the outside of said cap 4. It must be noted that, in the embodiment described herein, a similar window, not shown, is produced on the cap 4 on the side opposite the window 21, so as to be disposed at the extension of the relative inner circular guide, opposite the guide 11, of the cap 4.

As already partly described, after release of the elastic protrusions of the slider 25 (or of the lever 14) from the corresponding projections of the linear guide 24 (or of the plate 10), actuation of the visor 3 by the user causes further vertical translation of the slider 25 with respect to the guide 24 and consequent translation, also substantially vertical, of the tie 17 which, engaged via the pin 18 in the slot 16, preferably elongated, of the lever 14, determines rotation thereof about the pin 12 of the plate 10, with consequent rotation of the inner visor 3.

Therefore, in the particular embodiment of the helmet 1 illustrated herein with reference to FIGS. 1, 2 and 3, by mounting the inner visor 3 on the cap 4 the right plate 10' of the device for actuation and mounting of the inner visor 3 is made integral with the right side of the cap 4 internally, for example using a screw and relative nut (not shown), and the corresponding left plate 10 is mounted, after prior assembly of the kinematic mechanism 14, 17, on the region 20 of the cap 4, for example using a screw 23 and a relative nut 22.

In particular, the kinematic mechanism 14, 17 is assembled by coaxially coupling the bushing 27 of the lever 14 with the pin 12 of the plate 10 and then constraining the pin 18 of the tie 17 to the slot 16 of the lever 14. The screw 23, inserted from the outside of the cap 4 in a specific hole 33 in the region 20 of the cap 4 and in the hole in the bushing 27 of the lever 14, as well as in another suitable hole produced in the pin 12 of the plate 10, is constrained to the relative nut 22, thus fastening the assembly constituted by the plate 10, the lever 14 and the tie 17 inside the region 20 of the cap 4.

Subsequent mounting of the linear guide 24 on the region 20 of the cap 4 (in a specific niche produced in this region 20) and of the slider 25 inside the guide 24, and simultaneous fastening of the pin 26 inside the hole 19 of the lever 17, complete assembly of the device for actuation and mounting for the inner visor 3, of the particular embodiment of the present invention illustrated here.

To further mount the inner visor 3 inside said device for actuation and mounting the side ends 3*b* thereof are inserted respectively inside the plate 10' and inside the coupling region 15 of the lever 14, only when the lever 14 is in the bottom overtravel position thereof. The forks 8, which engage directly with the pin 12' of the plate 10' and indirectly with the pin 12 of the plate 10, by means of the bushing 27, facilitate and guide centering of the inner visor 3.

It must be noted that this mounting of the side ends 3*b* of the inner visor 3 takes place without prior engagement of the top hook 6 inside the seat 5 under the cap 4 and therefore in a lower position of the inner visor 3 with respect to said bottom operational end of travel position (that is, in the aforesaid overtravel position).

In this mounting position, the projecting teeth 9 of the inner visor 3 thus reach the relative guides 11 at the aforesaid downward extension of said guides 11.

At this point, a slight inward elastic deformation of the teeth 9 with respect to the relative side ends 3*b* of the inner visor 3 allows insertion thereof in the corresponding circular guides 11 inside the portions 20 of the cap 4. It must be noted that this insertion also takes place in the extended portion of the guides 11 (overtravel) and therefore at said window 21 of the region 20 of the cap 4. Although not shown, as already mentioned a similar window in the cap 4 is also present at the extension of the corresponding circular guide opposite the guide 11, produced on the symmetrically opposed side with respect to said window 21.

Mounting of the inner visor 3 on the cap 4 is completed by a subsequent upward rotation, that is, toward the top edge of the viewing aperture 200 of the helmet 1, of the inner visor 3 and slight elastic deformation of the hook 6, suitable to allow it to move beyond the stop 7.

Removal of the inner visor 3, an operation required, for example, if it is to be replaced, is implemented by performing the same operations performed for mounting in reverse order. In particular, the inner visor 3 must be taken to the bottom operational end of travel position thereof, in which the hook 6 of the visor 3 engages with the stop 7 of the cap 4 and then, using elastic deformation, the hook 6 must be released from the stop 7. At this point, due to the downward extension (overtravel) of the guides 11, it is possible to further rotate the inner visor 3 downward, to reach the maximum bottom end of travel position, given by said guides 11. In this position, due to the windows 21 of the cap 4, through which the teeth 9 can be reached by the user, the projecting teeth 9 of the additional visor can be elastically deformed inward, exerting local pressure, and then said teeth 9 can be released form the relative guides 11. Deformation of the projecting teeth 9 is made possible and facilitated by the cutout 31 of the lever 14 and by an analogous cutout present on the plate 10'. Subsequent extraction of the inner visor 3, disengaged from the pins 12, 12', and also from the control lever 14, allows removal thereof from the helmet 1.

It must be noted that, in the embodiment described here, the structure and configuration of the outer visor 2 and of the inner visor 3 are such that if the outer visor 2 is closed, removal of the visor 3 as described above, that is, when it has been disengaged from the stop 7 and is in the overtravel region of the circular guides 11 inside the cap 4, and the projecting teeth 9 have also been disengaged from said guides 11, is not possible, due to the impact of said inner visor 3 against the inner surface of the visor 2. This forms a further safety element against accidental release of said inner visor 3.

FIGS. 4, 5, 6*a*-6*c* and 7 show an alternative embodiment of the device for actuation and mounting of the inner visor 103 of a helmet 1, according to a further embodiment of the present invention.

Analogously to the embodiment in FIG. 2, in this embodiment (of which only the left side thereof is visible) the inner visor 103, preferably a sun visor, comprises a central shielding portion 103*a*, at the top of which a hook 106 projects, and two ends 103*b*, at the sides of the central portion 103*a*, which each have a fork 108 and a tooth 109 projecting transversely. Both the area adjacent to the hook 106 and the plate-like portion that supports each projecting tooth 109 of the inner visor 103 are elastically deformable.

The device for actuation and mounting of this inner visor 103 comprises, analogously to the embodiment in FIG. 2, for each side of said inner visor 103, a mounting plate 110, having a pin 112 on which the fork 108 of each end 103*b* of the inner visor 103 engages, directly or indirectly, and a circular guide 111, in the form of circular groove produced on the inner surface of a portion 20 of the cap 4 and provided with a through window 121. This groove 111, positioned at said plate 110, is structured to allow engagement of a relative projecting tooth 109 provided on each end 103*b* of the inner visor 103.

The device for actuation and mounting also comprises, just as the one shown in FIG. 2, a control lever 114 of the inner visor 103, provided with a hole 127, for engaging with the pin 112 of the plate 110, and a region 115 shaped to retain the end 103*b* of the visor 103, at least in a direction transverse to the direction along which the two arms of the fork 108 extend. The region 115 also comprises a cutout 131, for the purpose of housing the respective projecting tooth 109 of the inner visor 103.

The circular guides 111 of the embodiment described here have, just as in the previous case, an extension (overtravel) beyond the bottom operational end of travel position reached by the inner visor 103 (and defined by the hook 106 engaging with a relative stop 7 of the cap 4), just as the cap 4, as mentioned, has through slots 121 (windows) at said extensions, in order to allow the assembly and disassembly operations of said visor 103, described above in relation to the embodiment in FIG. 2.

Unlike the embodiment shown in FIG. 2, however, the device described herein comprises a rocking lever 117, provided with two end slots 118, 119, and a central hole 129, suitable to engage in a pin 128 provided on the plate 110. This plate also comprises a recess 130 to guide rotation of the lever 114 during actuation of the inner visor 103.

The end slots 118 and 119, suitably elongated, of the rocking lever 117 engage respectively with a pin (not shown) projecting from a projection 116 of the control lever 114 and with a pin 126 projecting on the inside of a slider 125.

The slider 125 is in turn mounted, as said, slidingly inside a guide 124, extending substantially horizontally, fastened to the outside of the cap 4. It must be noted that, although translatable sliders have been described above as manual control members for actuation of the inner visor 3 or 103 by the user, any other control member, such as a toothed wheel constrained to a rack, can be alternatively used, without departing from scope of protection of the appended claims.

Finally, again analogously to the embodiment in FIGS. 1-3, the hook 106 projecting from the top of the central shielding portion of the visor 103, with a relative bottom stop 7 integral with the cap 4, and a possible further top stop element—direct or indirect—for said visor 103, such as the top end of the circular guides 111 for the tooth 109 (or the top side of a mounting plate 110 for the lever 114), defines suitable means to limit rotation of said inner visor 103 with respect to the cap 4.

Figure 7:
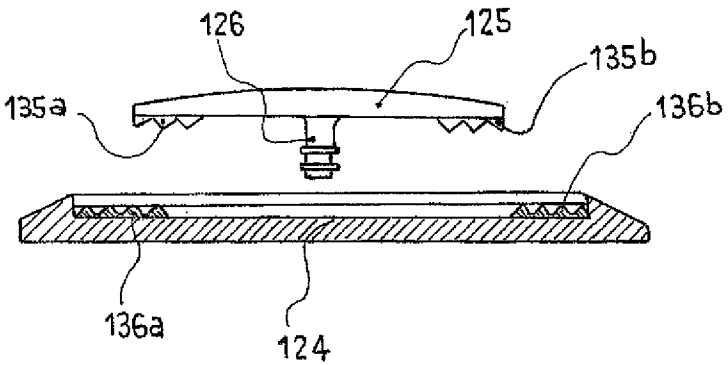
FIG. 7 is a partially cross-sectional side view of a slider to control the inner visor of the helmet partially shown in FIGS. 4, 5, 6*a*-6*c*.

Analogously to the embodiment described with reference to FIGS. 1-3, as can be seen in FIG. 7, also in this case a system for temporary elastic locking of the position of the inner visor 103, comprising elastic protrusions 135*a*, 135*b* and corresponding projections 136*a*, 136*b*, integral or integrated respectively with the control member (slider) 125 and with the relative linear guide 124, ensure the inner visor 103 is maintained in stable positions with respect to the cap 4, at least in the top end of travel and bottom end of travel positions of said inner visor 103.

Figure 8:
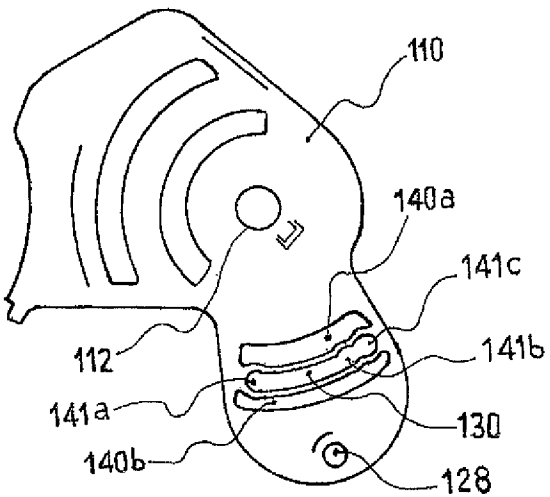
FIG. 8 is a front view of a partly modified supporting plate of the helmet in FIG. 4.

Alternatively, or in addition to the solution above, with reference to FIG. 8, said system for temporary elastic locking of the position of the inner visor 103 can comprise a plurality of temporary housing seats, produced inside the guide 130 provided on the mounting plate 110, and having elastically deformable end projections for an element sliding inside said guide 130 and integral with the control lever 114. These seats define stable, albeit temporary, positions for the lever 114 with respect to the plate 110 and therefore for the inner visor 103 with respect to the cap 4 of the helmet.

More in particular, in the system for temporary elastic locking of the position of the inner visor 103, the through guide 130 inside which the pin (not shown) of the control lever 114 slides has enlarged areas 141*a*, 141*b* and 141*c*, which are structured so as to temporarily retain said pin of the lever 114. The top and bottom outer walls of this through guide 130 are made elastically deformable due to two lightening through holes 140*a*, 140*b*, positioned above and below the guide 130. The purpose of these holes 140*a*, 140*b* is to reduce the thickness of the top and bottom side walls of the through guide 130, thereby making elastic deformation thereof possible. The pin of the lever 114 is therefore shaped in a manner to temporarily lock in said enlarged areas 114*a*, 141*b* and 141*c*, substantially engaging with the ends of these enlarged areas 141*a*, 141*b* and 141*c*. By applying sufficient force to the pin of the lever 114 to elastically deform said ends of the areas 141*a*, 141*b* or 141*c*, the lever 114 is able to leave the temporary locking positions defined by said areas 141*a*, 141*b* and 141*c*, which, in the embodiment shown in FIG. 8, correspond to the top end of travel, the bottom operational end of travel and the end of bottom overtravel positions of said inner visor 103.

It must be noted that the use of alternative means to limit rotation of the inner visor 3 or 103 to those described herein, even if at least partly separate from the circular guides 11, 111, can be used without departing from the scope of protection of the claims of this patent.

With regard to mounting of the embodiment shown in FIG. 3, those skilled in the art will have no difficulty in identifying, in the operations described with reference to FIG. 2, the operations required for said mounting.

Figure 6B:
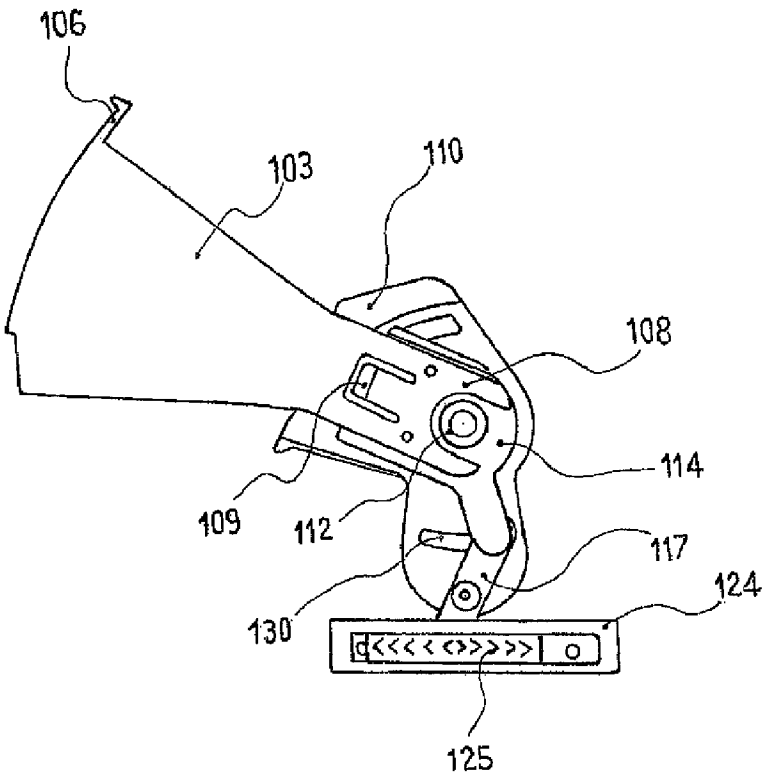
FIGS. 6*a*-6*c* are side views, taken from inside the helmet, of the additional visor and of the corresponding device for actuation and mounting in FIG. 3 in different positions taken by said additional visor, during actuation thereof by the user.
Figure 6A:
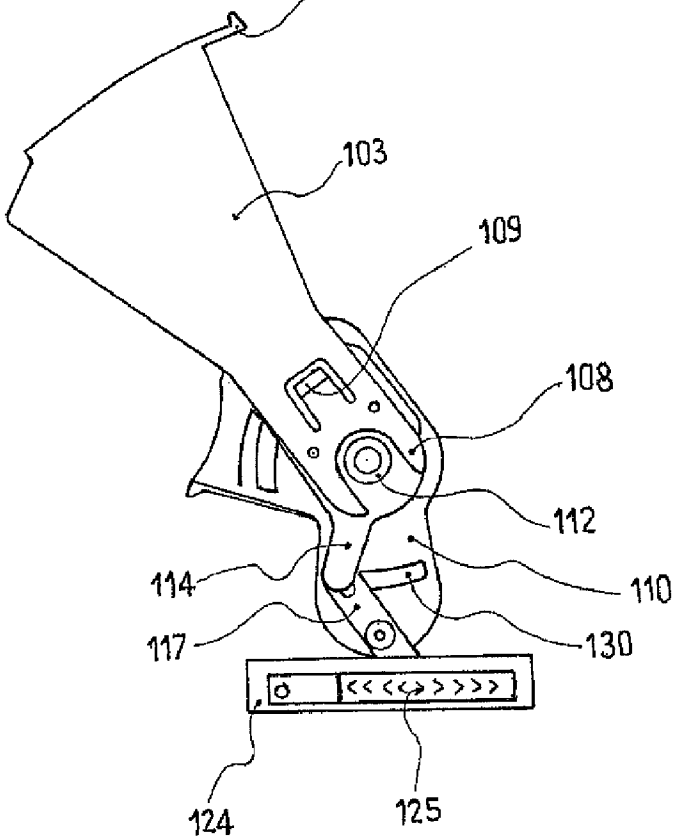
Figure 6C:
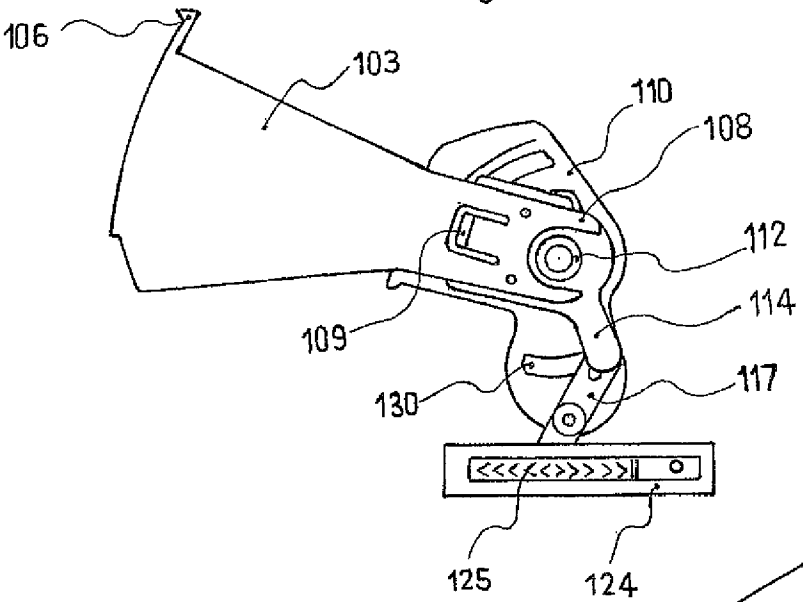

With reference now to FIGS. 6*a*-6*c*, which respectively show the completely raised position of the inner visor 103 (that is, the top end of travel thereof), the position of maximum interception of the aperture 200 of the helmet 1 (that is, the bottom operational end of travel thereof) and the position of maximum downward rotation (corresponding to the overtravel in the extension of the circular guides 111), the visor 103 described here is actuated by translation, by the user, of the slider 125 in the horizontal direction with respect to the guide 124, said translation determining rotation of the rocking lever 117 about the pin 128 of the plate 110, and in turn rotation of the control lever 114 about the pin 112.

Finally, this rotation of the lever 114 about the pin 112 determines rotation of the visor 103 with respect to the cap 4.

The invention claimed is:

1. Protective helmet, comprising:

a first outer visor to intercept the viewing aperture of the helmet mounted rotatably on said helmet;

a second visor mounted, inwardly to said first outer visor, rotatably on a cap of the helmet; and a device for actuation and mounting of said second visor on an interior side of said cap, wherein said second visor, which is at least partly elastically deformable, comprises a shielding portion, two ends at sides of said shielding portion, a fork at least at one of the ends, and at least one externally projecting tooth formed on the second visor, which is elastically movable with respect to said second visor, and wherein said device for actuation and mounting comprises at least one pin for engaging, directly or indirectly, with said fork, and at least one circular guide inside which said projecting tooth of said second visor is removably coupled in a sliding manner, said at least one pin and said at least one circular guide being integral or integrated with said cap.

2. Protective helmet as claimed in claim 1, wherein said device comprises a manual control member constrained in a movable manner to the cap of said helmet and at least one kinematic mechanism to transmit motion from said manual control to said second inner visor.

3. Protective helmet as claimed in claim 2, wherein said kinematic mechanism to transmit motion comprises a mechanical transmission connected to said manual control member and to said second visor at or in proximity of said fork.

4. Helmet as claimed in claim 3, wherein said kinematic mechanism comprises at least one tie constrained to said second visor and to said manual control.

5. Helmet as claimed in claim 3, wherein said kinematic mechanism comprises at least one lever constrained to said second visor and to said manual control.

6. Helmet as claimed in claim 2, wherein said manual control is a slider.

7. Helmet as claimed in claim 2, wherein said kinematic mechanism to transmit motion comprises a further lever hinged to said at least one pin and removably connected to said fork.

8. Helmet as claimed in claim 1, wherein said device for actuation and mounting of said second visor comprises means to limit rotation of said second visor between a top end of travel position with said second visor disengaged from the viewing aperture of the helmet, and a bottom operational end of travel position intercepting said viewing aperture of the helmet.

9. Helmet as claimed in claim 8, wherein said means to limit rotation of said second visor comprise at least one hook projecting from the top of said shielding portion of said second inner visor and at least one stop for said hook, said stop being integral with the cap of said helmet.

10. Helmet as claimed in claim 8, wherein said means to limit rotation of said second visor also comprise elastic means for temporary locking of one or more positions of said second visor.

11. Helmet as claimed in claim 8, wherein said at least one circular guide for said at least one projecting tooth of said second visor extends, at least downward, beyond the position reached by said at least one projecting tooth when said second visor is disposed at said bottom operational end of travel position.

12. Helmet as claimed in claim 1, wherein said at least one circular guide and said at least one pin of said actuation and mounting device of said second visor are mounted or made inside said cap.

13. Helmet as claimed in claim 1, wherein said at least one circular guide comprises a circular groove produced inside said cap, said groove being provided with a through slot.

14. Helmet as claimed in claim 13, wherein said slot is positioned at the portion of said at least one circular guide that extends downward beyond the position reached by said at least one projecting tooth when said second visor is disposed at said bottom operational end of travel position.

15. Helmet as claimed in claim 1, wherein said second visor comprises two forks at both of the side ends thereof and two externally projecting teeth, at or in proximity of each of said side ends and in that said device for actuation and mounting of said second visor comprises two pins for engaging, directly or indirectly, with said two forks and two circular guides inside which said two projecting teeth are removably coupled in a sliding manner.

16. Helmet as claimed in claim 1, wherein said second inner visor is a visor for partly shielding the light.

* * * * *